United States Patent [19]

McCarthy

[11] Patent Number: 4,773,544

[45] Date of Patent: Sep. 27, 1988

[54] MULTIPLE POCKET PEN HOLDER

[76] Inventor: Gerald A. McCarthy, 6812 Stanley Ave., Carmichael, Calif. 95608

[21] Appl. No.: 83,162

[22] Filed: Aug. 10, 1987

[51] Int. Cl.[4] ..... A47F 7/00

[52] U.S. Cl. ..... 211/69.1; 211/69.3; 206/214; 206/224; 206/371; 206/443

[58] Field of Search ..... 211/69.1, 69.3, 69.5, 211/69, 69.9, 70, 205; D6/457, 461, 469, 467; D7/73, 74; D19/77, 81, 84, 85; 206/214, 443, 485, 371, 224

[56] References Cited

U.S. PATENT DOCUMENTS

| | | | |
|---|---|---|---|
| 421,352 | 2/1890 | DeWeese et al. | 211/70 X |
| 2,488,087 | 11/1949 | Kravitt | 211/70 X |
| 2,500,115 | 3/1950 | Burlin | 211/70 |

FOREIGN PATENT DOCUMENTS

| | | | |
|---|---|---|---|
| 385436 | 3/1965 | Switzerland | 211/69 |
| 273434 | 7/1927 | United Kingdom | 211/205 |

*Primary Examiner*—Ramon S. Britts
*Assistant Examiner*—Blair M. Johnson
*Attorney, Agent, or Firm*—Mark C. Jacobs

[57] ABSTRACT

A multiple pen holder for pens having a pocket clip, wherein the pens are stored cap down-barrel up, wherein the clip of the barrel of each pen cooperates with a part of the holder to permit one hand removal and replacement of each pen's barrel within its cap.

The holder may assume many configurations and hold any number of pens, the number being limited only by the physical size of the product.

8 Claims, 2 Drawing Sheets

MULTIPLE POCKET PEN HOLDER

BACKGROUND OF THE INVENTION

Two problems all too often encountered by artists, draftsmen, engineers, students, lawyers, architects and all other persons who use a multiplicity of pens in close proximity of time are (1) where is the cap for a pen and (2) where is the green cap for the green pen.

All too often pens get mismatched tops placed on them. Thus is not only unsightly, but can lead to premature drying out of felt tip pens because brand A cap is not a perfect fit for a brand B barrel, thereby letting air reach the felt tip and dry it out.

Ofttimes a pen cap will fall to the floor, or be swept under the user's work papers only to become misplaced for what seems like a year. Thus there is a need for a product that prevents felt tip dry out, and which prevents the top from a pen from becoming mislaid.

It is an object therefore to provide a product that fits on a desk and can hold a plurality of pocket pens.

Another object is to provide a product wherein the pen's cap cooperates with the product to permit one handed access and replacement of the pen barrel into its respective cap.

Yet another object is to provide a product that can hold large numbers of different colored pens.

Still another object is to provide a product that is capable of holding a first brand of pens and which by suitable adjustment can be modified to hold a second brand of pens.

Other objects of the invention will in part be obvious and will in part appear hereinafter.

The invention accordingly comprises the features, properties and the relation of components which are exemplified in the following detailed disclosure, and the scope of the application of which will be indicated in the claims.

For a fuller understanding of the nature and object of the invention, reference should be made to the following detailed disclosure taken in conjunction with the accompanying drawings.

SUMMARY OF THE INVENTION

A multiple pen holder useful for artists, draftsmen, etc. wherein the pens are retained cap down-barrel up and wherein the cap cooperates with the holder to permit one handed removal and replacement of pens from the holder is disclosed.

DESCRIPTION OF THE PREFERRED EMBODIMENT

Figure 1:
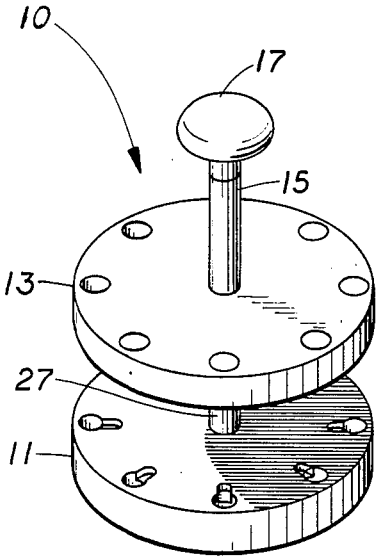
FIG. 1 is a perspective view of a first embodiment of this invention.
Figure 2:
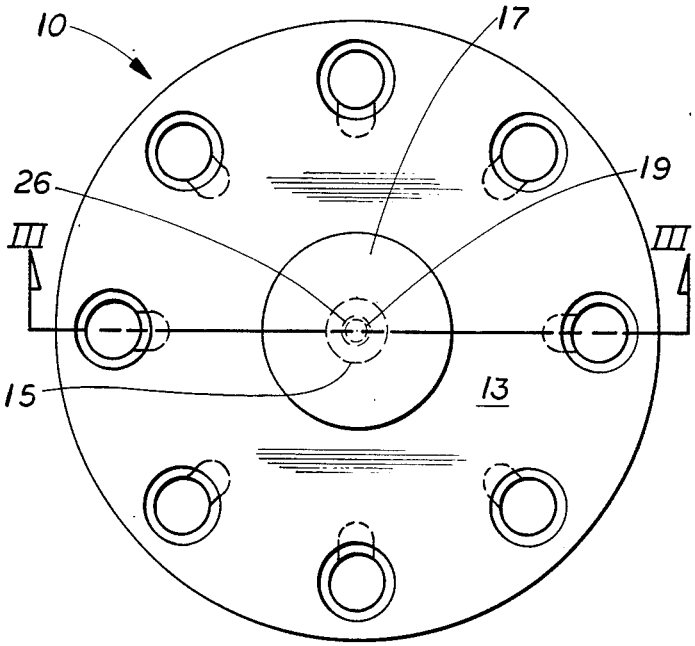
FIG. 2 is a top plan view of the device shown in FIG. 1.
Figure 3:
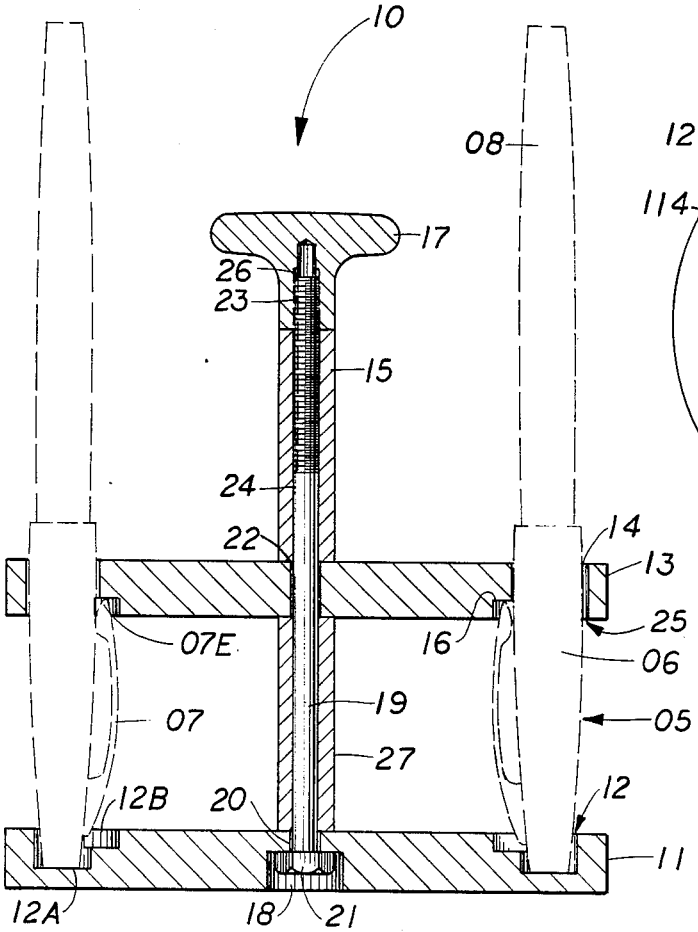
FIG. 3 is a sectional view taken along the line III—III of FIG. 2.

The multiple pen holder and carrying device 10 of this invention is seen in the first embodiment in FIGS. 1 through 3. Holder 10 has as its main elements a bottom plate 11 spaced from a top plate 13. A tubular riser 15 is mounted on the top surface of plate 13 and superposed on the riser 15 is a knob 17. They are all retained in the spaced relationship shown in FIG. 3 by a threaded bolt 19.

In detail, bottom plate 11 includes a plurality of recesses 12 formed in the upper surface of the bottom plate. Recess 12A is generally circular in cross section, or it can be made concave hemispherical as may be convenient. First recess 12A is made to a first depth usually about $\frac{1}{4}''$ deep. Second recess 12B adjacent thereto and communicating therewith may also be circular and slotted out to 12A as well as any other shape in cross-section. Recess 12B descends to a lesser depth than recess 12A as from the upper surface of the bottom plate. The reason for the offset in depth of the two adjacent recesses is the fact that 12B is intended to receive the pocket clip 07 mounted on the pen cap 06, and is known and seen in FIG. 3 the clip 07 is spaced from the closed end of the cap.

A multiplicity of first recesses 12A and 12B are formed in bottom plate 11. The number can vary according to the diameter of the plate 11. Obviously the number of laterally spaced first recesses 12 in the bottom plate 11 has to correspond to the number of bores 14 in the top plate 13.

Bore 18 in bottom plate 11 external from lower surface of said plate at least $\frac{1}{4}''$ inwardly. Throughbore 20 concentric with bore 18 and of a smaller diameter extends through bottom plate 11.

Top plate 13 may be of the same, smaller, or of a greater diameter than bottom plate 11. The only requirement is the throughbores 14 align with recesses 12 in the bottom plate such as to be able to receive the pens 05.

Throughbore 14 are sized in diameter to receive pens 05. Recessed slots 16 communicate with throughbores 14 laterally and are in the same radial alignment as recesses 126.

It should be noted that the combination of recess 16 with its throughbore 14 forms a keyhole shaped opening 25, facing downwardly, while designator 12 is a keyhole shaped opening formed from recesses 12B and 12A facing upwardly.

Top plate 13 further includes a central throughbore 22 of a cross section sufficient to pass threaded bolt 19 therethrough.

Tubular riser 15 is disposed over throughbore 22 and is seen to be optionally interposed between top plate 13 and knob 17. Its disposition is recommended, as access to knob 17, is easier if said knob is not located down between the upstanding pens 05. The tubular riser 15 may vary in height from about $\frac{1}{2}''$ to about $1\frac{1}{2}''$ and of a cross section of about $\frac{1}{2}''$. Tubular riser 15 has an elongated central bore which bore is sized to pass threaded bolt 19 therethrough and for such is of about $\frac{1}{4}''$ to $\frac{3}{8}''$ in diameter. Tubular riser 15 could also be integral with plate 13.

Knob 17 can be any type of conventional drawer or cabinet pull or knob. It includes a threaded bore 18 adapted to receive the threads 23 of bolt 19 or a fastener specially made for the unit.

An inspection of FIG. 3 would lead one to inquire what keeps top plate 13 spaced from bottom plate 11. The answer is pen caps 06 acting above or in concert with a tubular spacer 27. Tubular spacer 27 is of adequate cross section to pass bolt 19 therethrough. In elevation tubular spacer 27 extends upwardly from the upper surface of plate 11 a distance slightly lower than the edge of pen clip 07, designated 07E, to thereby permit clip 07's edge 07E to fit into recess 16. Spacer 27 could also be integral with plate 11, or top plate 13.

For aesthetic purposes it is recommended that tubular spacer 27 be of substantially the same diameter as riser 15.

To assemble holder 10, whether or not spacer 27 is employed the bolt 19 is placed through counter bore 18 and throughbore 20. Head of bolt 21 stops at the deepest point of counter bore 18 as per FIG. 3. The closed end of each pen cap 06 is placed into recess 12A with clip 07 set into recess 12B to serve as an indexing mechanism. While holding the plurality of pens between the fingers, plate 13 is lowered into bolt 19 such that the open end of each cap 06 protrudes through an opening 14 in plate 13 and optionally edge 07E can index into recess 16 if such is present as in FIG. 3, or said edge 07E rests abuttingly against the lower side of plate 13, as per FIG. 4. After a wedge fit is made of the open ends of the caps into throughbores 14, tubular riser 15 is placed above plate 13 onto bolt 19, and the threads 26 in knob 17 are threaded onto the threads 23 of said bolt, to thereby complete the assembly of device 10.

Figure 4:
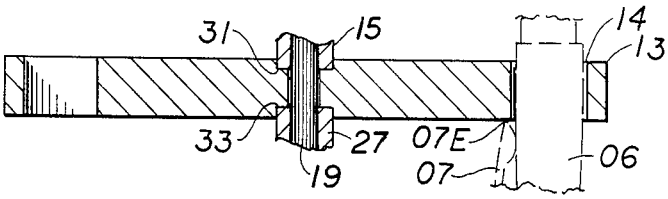
FIG. 4 is a variant of one element of the first embodiment as seen in FIG. 3.

While not shown in the figure it is contemplated by the inventor to include an annular recess on the upper surface of plate 13 to index and retain the tubular spacer at a predetermined position. Such an annular recess is also contemplated to aid in the positioning of spacer 27. Reference is made to FIG. 4 wherein such annular recesses 31 and 33 are depicted. Obviously a corresponding recess to 33 may be placed in bottom plate 11 either in addition to or instead of recess 33.

If spacer 27 is not employed, and if the threads of threaded bolt 19 extend the full length of the bolt, a nut may be employed in place of spacer 27 to help retain the bolt in the bottom plate for convenience of assembling the unit with pen caps, the aforementioned nut would tighten bolt 19 in plate 11. Note also that spacer 27 can be internally threaded to accomplish the same purpose.

Figure 5:
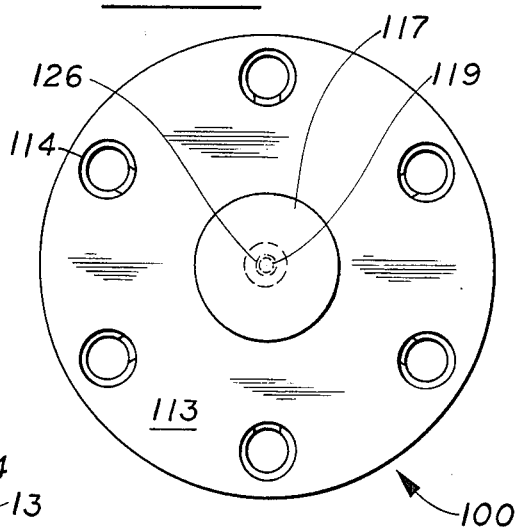
FIG. 5 is a top plan view of a second embodiment of this invention.

In the second embodiment of the invention, as seen in FIG. 5, which embodiment is designated 100, the features of the invention are similar to those of the first embodiment. Thus like numerals of the series utilized in the description of the first embodiment will be raised by 100 to describe similar parts of the second embodiment, i.e. 13 top plate is 113 top plate. All parts not identified specifically with respect to the second embodiment are the same as have previously been discussed with respect to the first embodiment.

Here embodiment 100 has a top plate 113 having a plurality, here six, of pen receiving bores 114. Handle 117 is shown mounted over tubular riser 115. Threads 126 of the handle 117 receive the threaded bolt 119.

It is to be seen that for this second embodiment, the indexing recess corresponding to 16 may be present or absent as may be desired. The point of novelty in this embodiment relates strictly to the number of cap receiving bores 114, which as noted from the drawing; are 6 in number. All other features of the device in this embodiment need no further explanation as they are the same as the first embodiment.

While embodiments of a circular configuration have been shown, wherein the number of cap receiving bores has been 6 and 8, it is readily seen that by enlarging the diameter of the top and bottom plates to accommodate pens, even larger numbers can be had.

Figure 6:
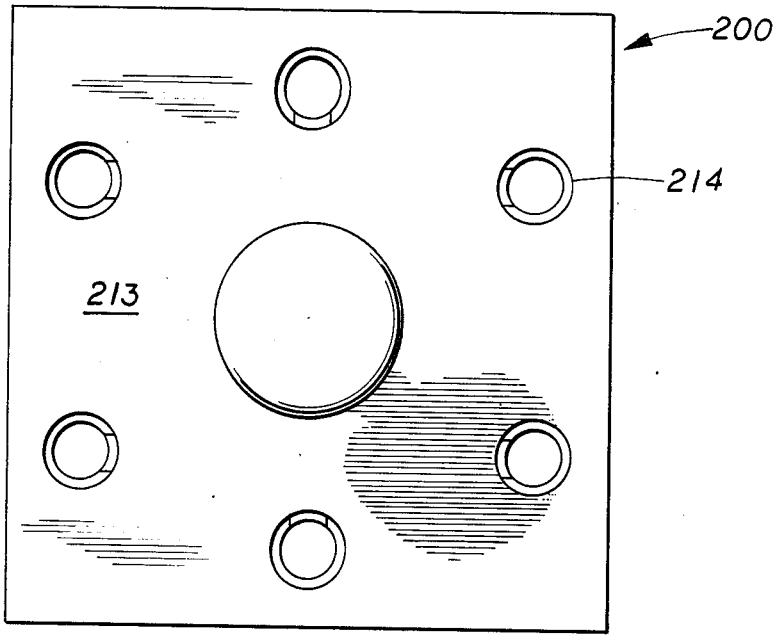
FIG. 6 is a top plan view of a third embodiment of the device of this invention.
Figure 7:
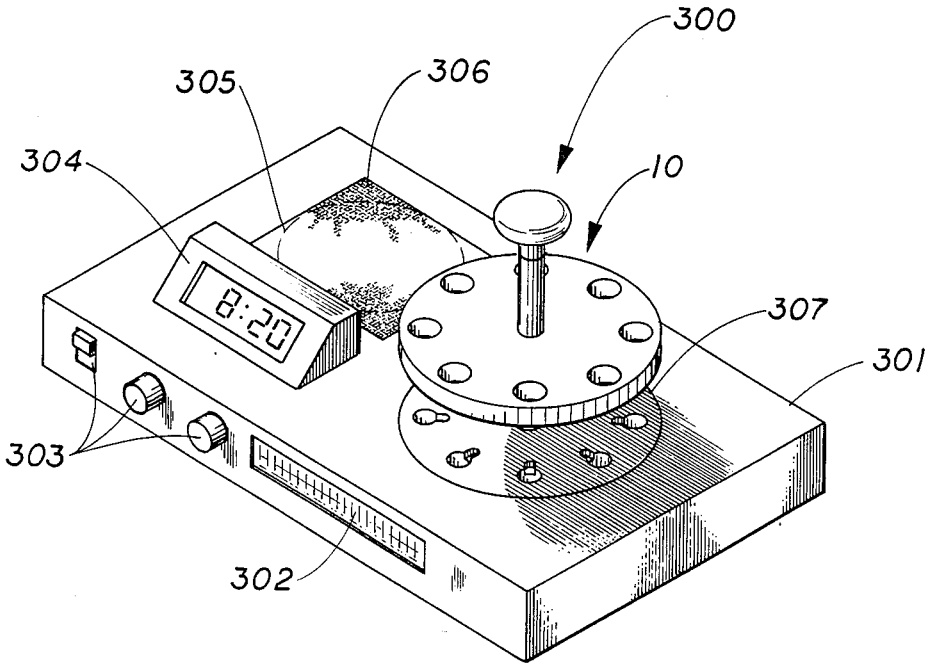
FIG. 7 is a perspective view of a desk accessory that incorporates the embodiment of FIG. 1 therein.

It is also to be seen that there is no criticality to using a circular disc for the top and bottom plates. Thus FIG. 6, illustrates embodiment 200 wherein as in the FIG. 5 embodiment six cap receiving bores are to be found. Top plate 213 however is seen to be of a square configuration and to have 6 bores 214. Naturally for the sake of aesthetics the bottom plate should preferably be of the same configuration. Such a square shaped embodiment can also optionally include the variant of the indexing recesses or it may omit them as may be desired.

The invention is also to be seen to be capable of incorporation into other devices. Thus pen holder 10 can be incorporated into an executive desk accessory 300 having a base 301. Dial 302 is for radio which is controlled by knobs 303 and plays through speaker 305 behind the grill cloth 306 which is flush with the upper surface of the base 301. An optional clock 304 is also depicted.

As can be readily understood bottom plate 11 is nested into a cutout 307 in base 301. This fit can be a friction fit for ready removal of pen holder 10, or said holder can be permanently secured therein as by adhesive, bolting or the like as is commonly understood in the assembly art. The mode of actual assembly is not critical.

Previously we have discussed the assembly of the first embodiment of the invention. All of the others assemble in like fashion.

The products of this invention may be made from any suitable materials. Thus the top and bottom plates may be made from ultra high molecular weight polyethylene, while the tubular riser, and spacer can be made from polyvinyl chloride or A.B.S. plastic. The handle may be made from any threadable plastic, wood, metal or ceramic. The threaded bolt may be of steel or aluminum or plastic.

It is further to be seen that other materials can be employed for each of these components. Thus the two plates could be made of metal or wood or other plastic.

The products of this invention are intended to hold all of one brand of fiber tipped pen at any one time. The diameter of the cap of these various pens may range from 5/16" to about ½". Since there is such a variance, the diameter of the cap receiving bore such as 14 can influence which pens can be utilized with the product. Thus it is preferred to make these bores at least a ½" inches across in order to maximize this pen, holding (per cap receiving capability).

Typical pen manufacturers whose products can be accommodated herein include Papermate, Faber-Castell and Pilot among others. The use of various combinations of bore sizes and clip recesses in the upper and lower plates will result in pen holders that can accommodate several different brands or types of pens rather than just one type or brand.

The pen holder of this invention not only permits one kind accessing of any particular pen, but also prevents pen caps from getting misplaced or lost.

The products of this invention are sure to find favor with draftsmen, architects, students, engineers as well as economists and any other person who does multi color drawing charting or graphing.

While not shown in the drawings, rubber feet may be applied to the underside of the bottom plate for added decoration. Also any one or more colored pigments and parts may be used to color the various parts of this product. Hot stamping and decals for decoration are also contemplated as decoration means.

While all of the pens in the embodiment shown are uniformly spaced from the central throughbore, such is not a requirement thus some could be spaced a greater distance from the outside edge of the plates.

Since certain changes may be made in the above product without departing from the scope of the invention herein involved, it is intended that all matter contained in the above description and shown in the accompanying drawings shall be interpreted as illustrative and not in a limiting sense.

I claim:

1. A multiple pen holder for easily accessing fibre tip pens which pens include a barrel having a point at one end, and a cap with a pocket clip thereupon, said multiple pen holder comprising a pair of spaced plates, one being a top plate and the other a bottom plate, both of which include a central throughbore;

the top plate having a plurality of peripheral throughbores each spaced inwardly from the outside edge of said plate, the bottom plate having an upper surface having a plurality of circular first recesses corresponding in number to the number of peripheral throughbores of said top plate, the top plate throughbores being circular and sized in diameter to receive a cap of a pen, wherein each recess of the bottom plate is vertically aligned with a respective peripheral throughbore of the top plate;

a second recess radially aligned with and disposed next to each of said first recesses and being shallower and of a smaller cross section than each of said first recesses and communicating therewith to form a plurality of keyhole shaped cutouts in said bottom plate, said cutouts being sized to receive a pen cap having a pocket clip thereon, a threaded bolt disposed in said central throughbore in said bottom plate and having a shaft passing through the central throughbore of each of said top and bottom plates;

a removable tubular riser having a central opening of a diameter to pass over said thread bolt's shaft and interposed between said top plate and a handle;

and a threaded handle adapted to receive the threaded end of said threaded bolt;

whereby when one or more pen caps are disposed in said keyhole cutouts of said bottom plate, and the open end of said caps are placed in the peripheral throughbores at the time the top plate is placed on said threaded bolt, said top plate will maintain a spaced relationship with bottom plate such that a user can with one hand insert pens into respective caps, and the caps will be retained between the top plate and the bottom plate, due to cooperation between said clips and said plates to prevent removal of said caps.

2. The multiple pen holder of claim 1 further including a spacer disposed on said threaded bolt and interposed between said top and bottom plates.

3. The pen holder of claim 2 wherein the top plate has an annular recess on its lower surface sized to receive said spacer.

4. The pen holder of claim 1 wherein the top plate on its underside has a clip receiving recess adjacent to and in lateral communication with each peripheral throughbore.

5. The pen holder of claim 4 wherein the top plate and bottom plate are of a circular configuration and said top plate's plurality of peripheral throughbores ranges from 6 to 8 in number, and the bottom plate's plurality of first recesses is the same number within the range of 6 to 8.

6. The pen holder of claim 1 wherein the configuration of the top and bottom plates is rectangular.

7. The pen holder of claim 1 wherein the bottom plate is incorporated into a desk accessory housing other office articles.

8. The multiple pen holder of claim 1 including a tubular riser disposed on said threaded bolt between said top plate and handle.

* * * * *